US011111465B1

(12) United States Patent
Gittlin

(10) Patent No.: US 11,111,465 B1
(45) Date of Patent: Sep. 7, 2021

(54) ERGONOMIC BATHING SOAP AND METHOD OF USE

(71) Applicant: Adam Gittlin, New York, NY (US)

(72) Inventor: Adam Gittlin, New York, NY (US)

( * ) Notice: Subject to any disclaimer, the term of this patent is extended or adjusted under 35 U.S.C. 154(b) by 116 days.

(21) Appl. No.: 16/656,904

(22) Filed: Oct. 18, 2019

Related U.S. Application Data

(60) Provisional application No. 62/747,496, filed on Oct. 18, 2018.

(51) Int. Cl.
*C11D 17/00* (2006.01)

(52) U.S. Cl.
CPC ..... *C11D 17/0047* (2013.01)

(58) Field of Classification Search
CPC ..... C11D 17/0047; A47K 7/00
See application file for complete search history.

(56) References Cited

U.S. PATENT DOCUMENTS 1,478,882 A * 12/1923 Bailly ..... C11D 17/04 510/440
2,243,634 A * 5/1941 Kadish ..... A47K 5/05 401/8
3,488,126 A * 1/1970 Avallone ..... A47K 7/028 401/8
4,062,792 A * 12/1977 McNabb ..... C11D 13/04 510/142
4,741,852 A * 5/1988 Ondracek ..... C11D 17/048 15/222
5,071,583 A * 12/1991 Martell ..... C11D 17/00 510/143
9,603,492 B2 * 3/2017 Cannata ..... A47K 5/04
10,070,758 B2 * 9/2018 Healy ..... A47K 5/04
2019/0029475 A1 * 1/2019 Hyde ..... A47K 5/05

* cited by examiner

*Primary Examiner* — Necholus Ogden, Jr.
(74) *Attorney, Agent, or Firm* — Leavitt Eldredge Law Firm

(57) ABSTRACT

An ergonomic soap includes a soap body extending from a first end to a second end, the soap body having a top surface; an elongated protrusion extending from the first end, the elongated protrusion having a curve that places an end of the elongated protrusion over the top surface; and a second protrusion extending from the second end, the second protrusion having a ring-shaped opening extending therethrough; the user engages their hand with the soap body such that the end of the first protrusion is positioned over the user's hand.

5 Claims, 3 Drawing Sheets

ERGONOMIC BATHING SOAP AND METHOD OF USE

BACKGROUND

1. Field of the Invention

The present invention relates generally to soap, and more specifically, to an ergonomic bathing soap that provides for soap that is easy for a user to handle and further provides for an ergonomically designed soap for teaching toddlers and children to bathe themselves.

2. Description of Related Art

Soap is well known in the art and are effective means to clean. For example, FIG. 1 depicts a conventional soap bar 101 having a rectangular body 103. In FIG. 2, a flowchart 201 depicts a method of use of soap bar 101. During use, the user will grasp the soap bar, use the soap bar, and then set down the soap bar, as shown with boxes 203, 205, 207.

One of the problems commonly associated with system 101 is inconvenience. For example, the user may have difficulty in grasping the soap bar resulting in the potential for the user to drop the bar. Further, the soap bar may be difficult to use for children and toddlers.

Accordingly, although great strides have been made in the area of soap, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
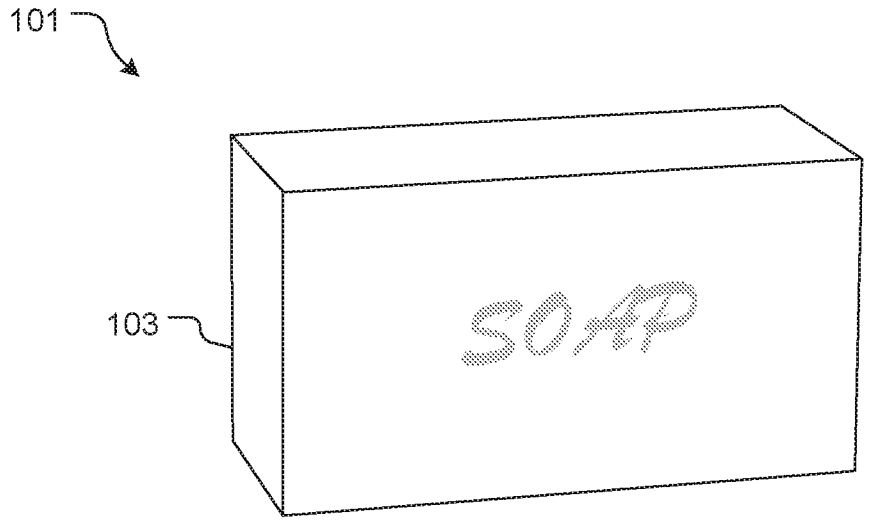
FIG. 1 (Prior Art)
FIG. 1 is an isometric view of a common soap bar.
Figure 2:
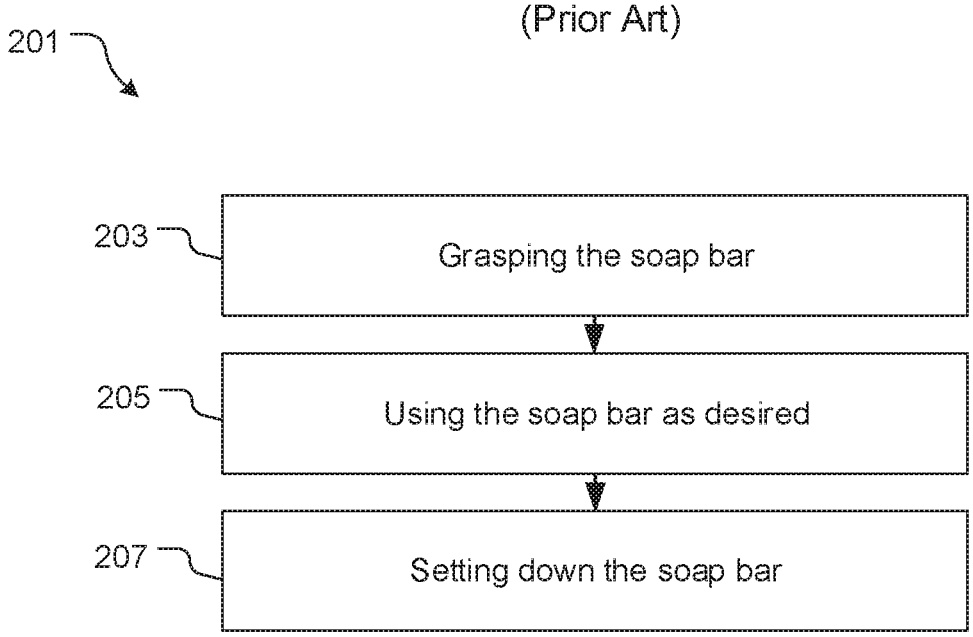
FIG. 2 (Prior Art)
FIG. 2 is a flowchart of a method of use of the soap bar of FIG. 1.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional soap bars. Specifically, the present invention provides for an ergonomic soap that is easy for a user, including a child, to grasp and use. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 3:
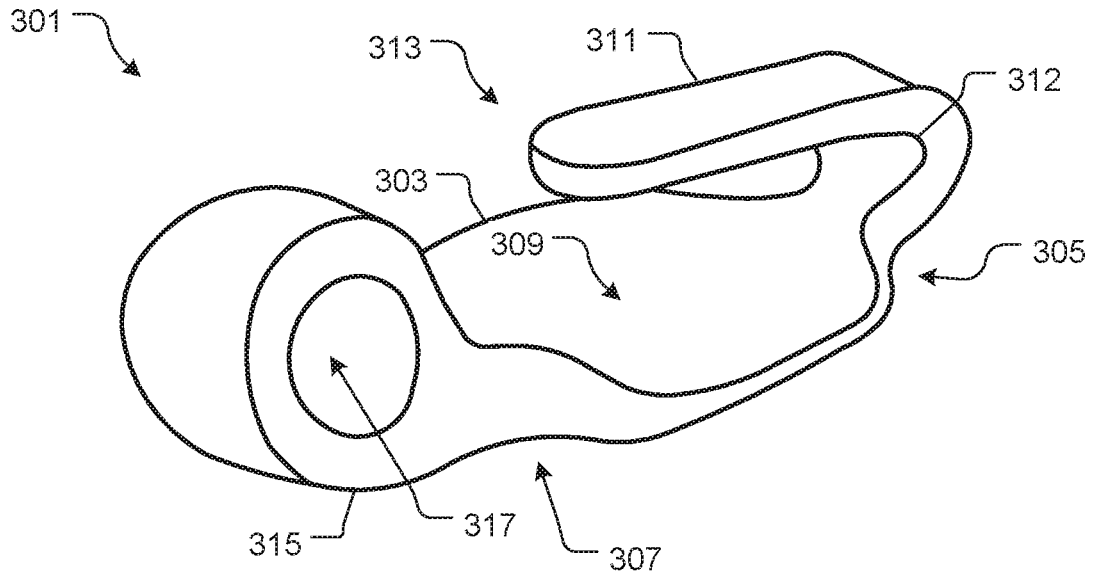
FIG. 3 is an isometric view of an ergonomic soap in accordance with the present application.
Figure 4:
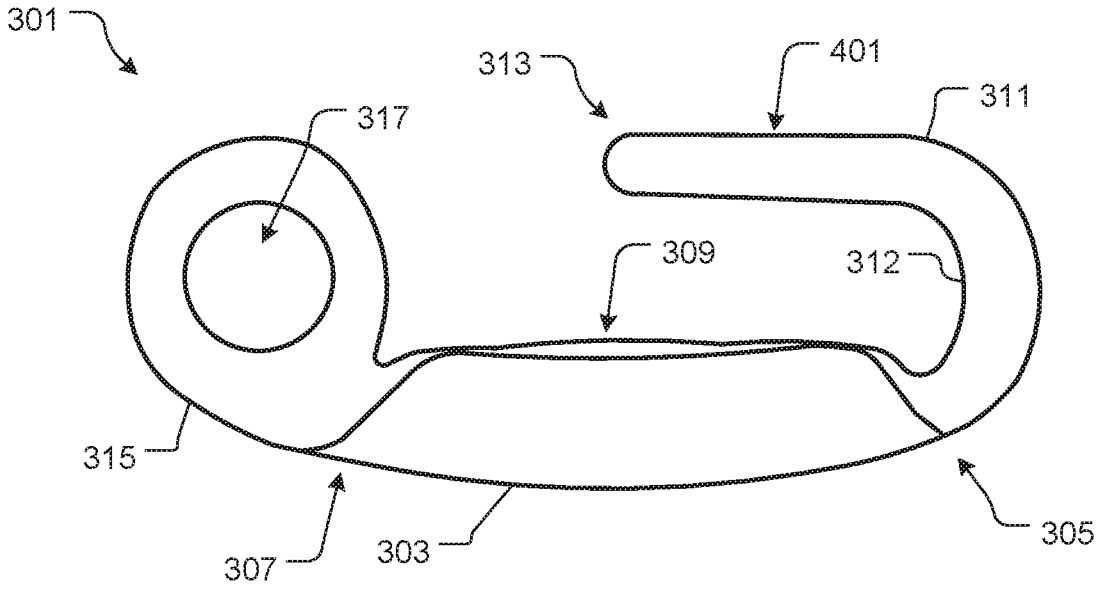
FIG. 4 is a side view of the ergonomic soap of FIG. 3.
Figure 5:
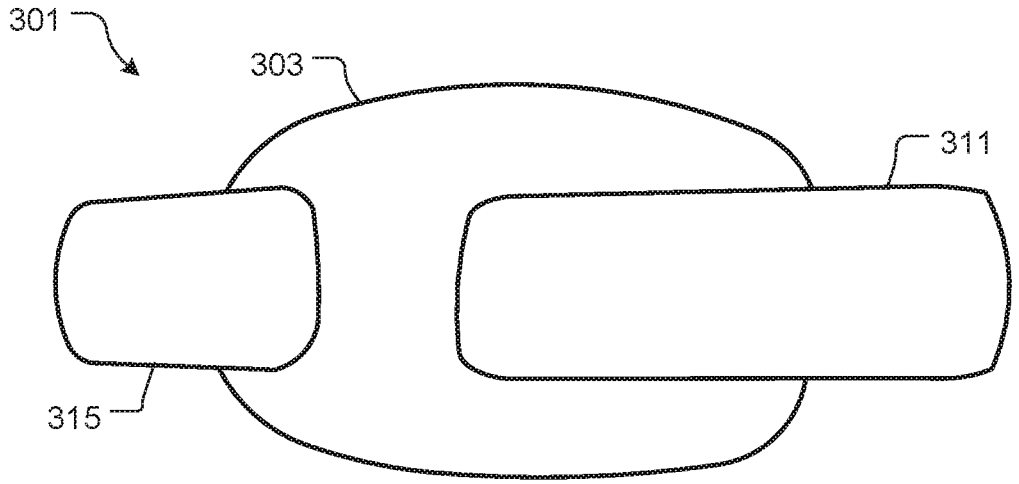
FIG. 5 is a top view of the ergonomic soap of FIG. 3.

Referring now to the drawings wherein like reference characters identify corresponding or similar elements throughout the several views, FIGS. 3-5 depict various views of an ergonomic soap 301 in accordance with a preferred embodiment of the present application. It will be appreciated that soap 301 overcomes one or more of the above-listed problems commonly associated with conventional soap.

In the contemplated embodiment, soap 301 includes a soap body 303 extending from a first end 305 to a second end 307 and having a top surface 309. The soap 301 further having an elongated protrusion 311 extending from the first end, the elongated protrusion having a curve 312 that places an end 313 of the elongated protrusion over the top surface 309 of the soap body. Further, the soap has a second protrusion 315 extending from the second end of the soap body, the second protrusion having a ring-shaped opening 317 extending therethrough.

It should be appreciated that the soap 301 can include a flat top surface 401 associated with the elongated protrusion and in some embodiments, surface 309 is curved to fit the user's hand. In addition, it is contemplated that the bottom surface of the soap can be smooth or corrugated with bumps or grooves. In addition, the composition of the soap can vary based on user need.

It should be appreciated that one of the unique features believed characteristic of the present application is the configuration of the ergonomic soap with the elongated protrusion and the second protrusion, wherein the user can engage their hand with the soap such that the elongated protrusion is extended over a top of the user's hand. The user can further use the ring-shaped opening to engage with one of their fingers to further ensure adequate grip. This feature allows for the user to avoid dropping the soap, and further provides for ease of use for children.

Figure 6:
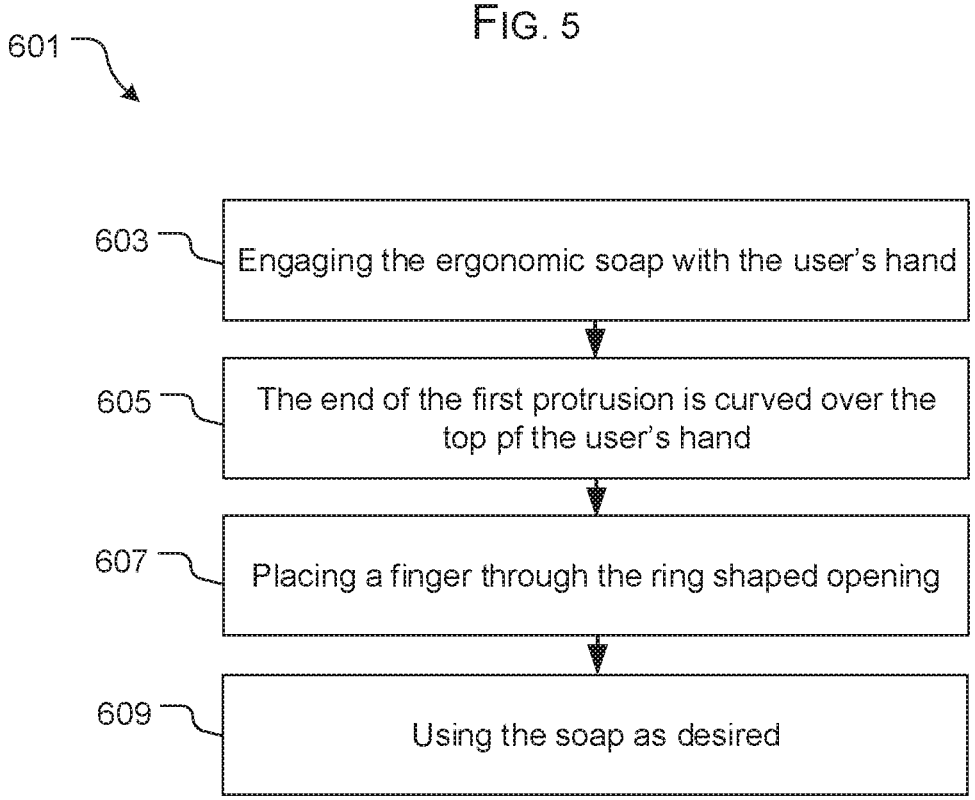
FIG. 6 is a flowchart of the method of use of the ergonomic soap of FIG. 3.

In FIG. 6, a flowchart 601 depicts a method of use of soap 301. During use, the user will engage their hand with the ergonomic soap such that the elongated protrusion is curved over the top of the user's hand, as shown with boxes 603, 605. If desired, the user can place a finger or thumb through the ring-shaped opening, as shown with box 607. The user will then proceed with using the soap as desired, as shown with box 609.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An ergonomic soap, comprising:

a soap body extending from a first end to a second end, the soap body having a top surface;

an elongated protrusion extending from the first end, the elongated protrusion having a curve that places an end of the elongated protrusion over the top surface, the elongated protrusion extending in a direction perpendicular to an elongated length extending from the first end to the second end; and a second protrusion extending from the second end, the second protrusion having a ring-shaped opening extending therethrough, the ring-shaped opening extending in a direction perpendicular to the elongated length;

wherein the user engages their hand with the soap body such that the end of the first protrusion is positioned over the user's hand.

2. The ergonomic soap of claim 1, wherein the elongated protrusion has a flat top surface.

3. The ergonomic soap of claim 1, wherein the top surface of the soap body is curved.

4. A method of using an ergonomic soap, the method comprising:

providing the system of claim 1;

engaging the ergonomic soap with the user's hand such that the end of the first protrusion is positioned over the user's hand; and using the ergonomic soap as desired.

5. The method of claim 4, further comprising:

placing one of the user's fingers within the ring-shaped opening.

* * * * *